US012668983B1

(12) United States Patent
Bowbeer

(10) Patent No.: US 12,668,983 B1
(45) Date of Patent: Jun. 30, 2026

(54) TOOL AND SYSTEM FOR MANIPULATING A STRING LINE AND LINE MARKING METHOD

(71) Applicant: Michael John Bowbeer, Alamo, CA (US)

(72) Inventor: Michael John Bowbeer, Alamo, CA (US)

( * ) Notice: Subject to any disclaimer, the term of this patent is extended or adjusted under 35 U.S.C. 154(b) by 338 days.

(21) Appl. No.: 18/608,730

(22) Filed: Mar. 18, 2024

Related U.S. Application Data

(60) Provisional application No. 63/453,418, filed on Mar. 20, 2023.

(51) Int. Cl.
*E04G 21/18* (2006.01)

(52) U.S. Cl.
CPC ..... *E04G 21/1808* (2013.01)

(58) Field of Classification Search
CPC ..... E04G 21/1808; E04G 21/1816; E04G 21/1825; E04G 21/1833
USPC ..... 33/1 G, 1 LE, 404, 413
See application file for complete search history.

(56) References Cited

U.S. PATENT DOCUMENTS 23,680 A * 4/1859 Grumman ..... G01B 3/1092 33/413
1,630,475 A * 5/1927 Elder ..... G01C 15/10 33/408
1,878,448 A * 9/1932 Cornuelle ..... E04G 21/1808 33/408
2,623,289 A * 12/1952 Kampel ..... E04G 21/1808 33/406
3,104,468 A * 9/1963 Sarles ..... E04G 21/1816 33/406
3,555,688 A * 1/1971 Smathers ..... E04G 21/1825 33/408
3,903,608 A * 9/1975 Garrison ..... E04G 21/1825 33/407
4,144,649 A * 3/1979 Huston ..... E04G 21/1816 33/409
4,231,156 A * 11/1980 Cooper ..... E01C 19/008 33/339
4,635,377 A * 1/1987 Park ..... G01C 9/28 33/381
5,173,004 A * 12/1992 Fahrenkrog ..... E01C 19/008 33/1 LE
5,186,119 A * 2/1993 Hlavin ..... A63C 19/062 33/1 G
5,878,505 A * 3/1999 Scarpellini ..... G01C 15/04 33/1 G
5,915,770 A * 6/1999 Bergstrom ..... H02G 1/00 294/174

(Continued)

*Primary Examiner* — George B Bennett
(74) *Attorney, Agent, or Firm* — Plager Schack LLP; Mark H. Plager; Naomi Mann

(57) ABSTRACT

Disclosed is a line engagement tool and system for marking a line within concrete or cement using the line engagement tool. The tool may include a lower tubular section configured to couple to the end of a pole, and an upper section configured to engage a string line. Using the tool, a line may be marked by attaching the string to a string receiving end of the tool, attaching a pole to a pole receiving end of the tool, then placing he string line into the wet cement and holding it in place remotely via the pole whereby the string line may be stretched across the cement to mark a line in the cement.

10 Claims, 4 Drawing Sheets

(56) References Cited

U.S. PATENT DOCUMENTS 6,044,568 A * 4/2000 Raymond ..... B44D 3/38 33/1 G
6,490,803 B1 * 12/2002 Butters ..... E04G 21/1833 33/405
6,760,974 B1 * 7/2004 Jorgenson ..... G01C 15/004 33/526
7,360,315 B2 * 4/2008 Knepp ..... E02D 5/38 33/644
7,779,546 B2 * 8/2010 Bond ..... G01C 15/02 33/409
7,861,420 B2 * 1/2011 Schwegler ..... E04G 17/064 33/645
8,826,555 B2 * 9/2014 Ruonavaara ..... E04G 21/1816 33/408
8,959,687 B2 * 2/2015 Bond ..... B25G 1/08 7/167
9,109,892 B2 * 8/2015 Carbajal ..... G01C 15/10
9,902,194 B2 * 2/2018 Jackson ..... B44D 3/38
10,626,627 B1 * 4/2020 Baynar, Jr. ..... E04G 21/1808
11,512,482 B2 * 11/2022 Alvarez Bonilla ..... E04G 21/18
11,753,835 B1 * 9/2023 LaMont ..... E04G 21/1841 33/404
2004/0006935 A1 * 1/2004 Moorhead ..... E04G 21/1833 52/166
2007/0089312 A1 * 4/2007 Wade ..... E04G 21/1833 33/409
2008/0256810 A1 * 10/2008 Akihary ..... E04G 21/1833 33/1 G
2008/0256812 A1 * 10/2008 Yandrick ..... G01C 15/06 33/294
2012/0102770 A1 * 5/2012 Ramos ..... G01B 3/00 33/407
2016/0376797 A1 * 12/2016 Scott ..... E04G 21/1816 33/406
2023/0349178 A1 * 11/2023 Fitzgerald ..... E04G 21/1825

* cited by examiner

TOOL AND SYSTEM FOR MANIPULATING A STRING LINE AND LINE MARKING METHOD

RELATED APPLICATION

This application claims benefit to U.S. Application No. 63/453,418 filed Mar. 20, 2023, which is incorporated by reference herein in its entirety.

BACKGROUND

The present disclosure relates generally to tools and systems for manipulating a string line and for marking a line in wet concrete or cement.

String lines may need to be remotely manipulated for various applications. For example, a string line may need to be set within wet cement at a location remote from arm's length. As such, an improved system for manipulation of a string line is desirable.

SUMMARY

According to various embodiments, disclosed is a tool for manipulating a string line, and a method for marking a straight line in wet cement or concrete using the string line and tool. In some embodiments, the disclosed tool may comprise a lower tubular section configured to couple to the end of a pole, and an upper section configured to engage a string line. In certain embodiments, the method for marking a line in wet cement may comprise attaching the string to a string receiving end of the tool; attaching a pole to the pole receiving end of the tool, opposite the string receiving end; placing one end of the string line in the wet cement via the pole, stretching the string line taught across the wet cement to snap a line in the cement. In embodiments, the procedure may be carried out by two persons, one who holds the pole, and a second person who pulls the string line. Once the pole with attached string line is placed onto wet cement, the second person on the other end of the string line may pull the string line taunt, then pinch the line with his/her fingers and raise up the line above the wet cement. The second user may then release the string line back onto the wet cement to snap a line. After this has been done, the first user with the pole and tool remove said items away from cement. A straight line is thus left in the wet cement created by pulling the line taunt and raising and releasing the line onto to the wet cement.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
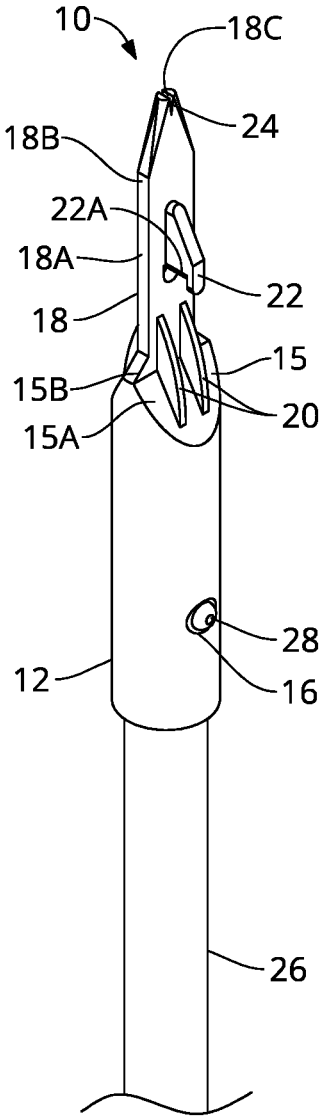
FIG. 1. is a top front perspective view of a line engagement tool for manipulating a string line according to certain embodiments, the tool shown installed to a pole.
Figure 2:
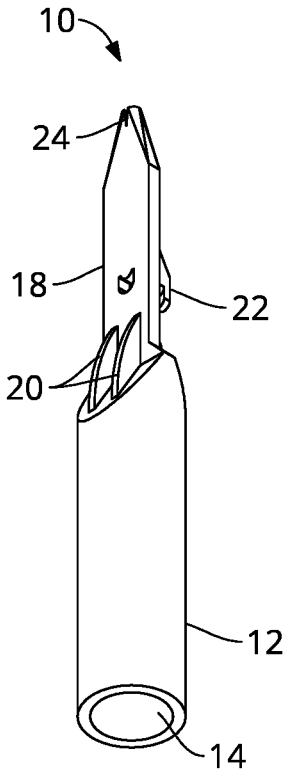
FIG. 2 is bottom rear perspective view of the line engagement tool.
Figure 3:
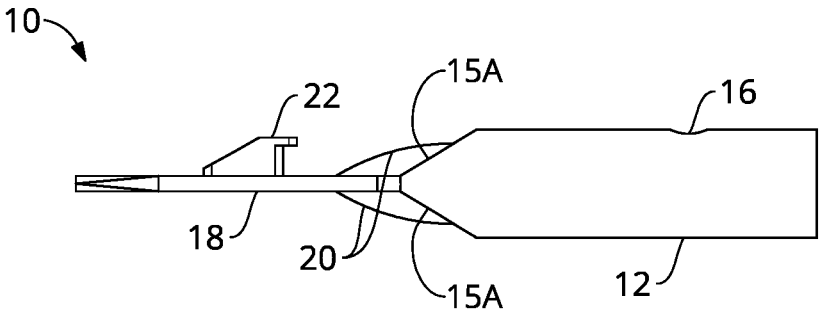
FIG. 3 is a side view of the line engagement tool.
Figure 4:
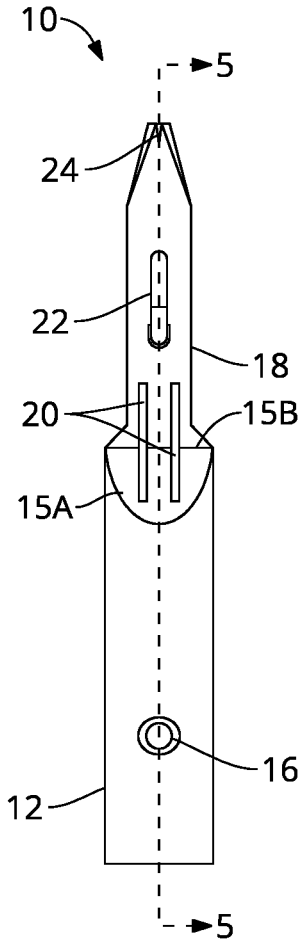
FIG. 4 is a front view of the line engagement tool.
Figure 5:
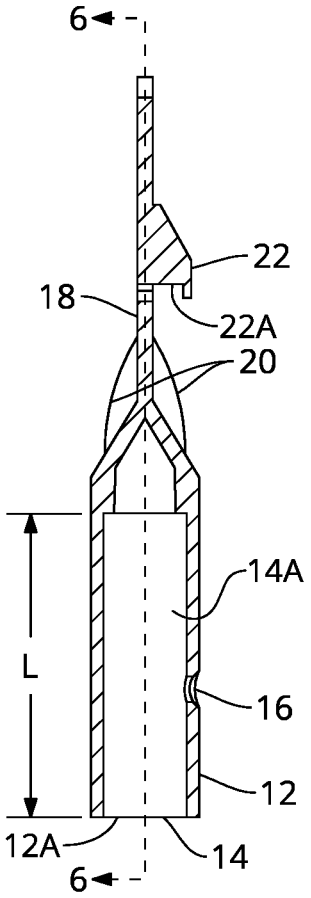
FIG. 5 is a section view taken along line 5-5 in FIG. 4.
Figure 6:
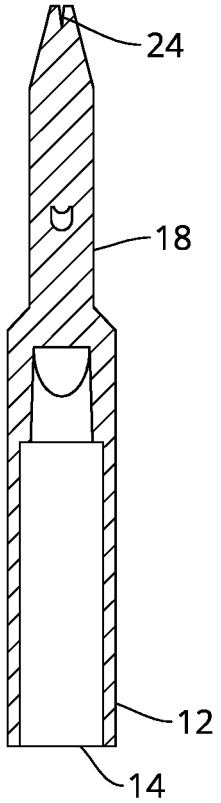
FIG. 6 is a section view taken along line 6-6 in FIG. 5.
Figure 7:
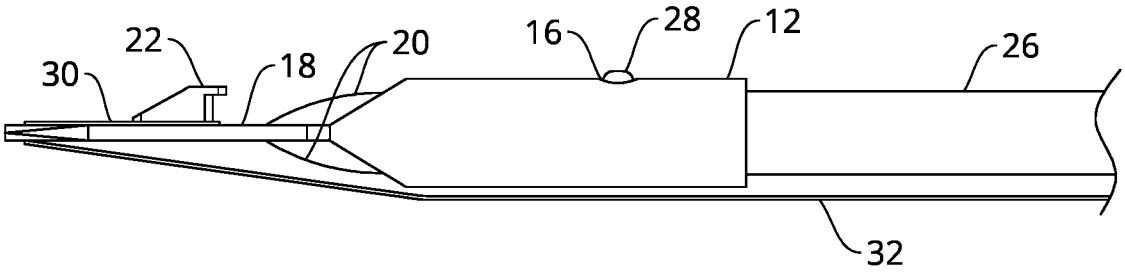
FIG. 7 is a side view of the line engagement tool, shown installed and with string engaged to the tool.
Figure 8:
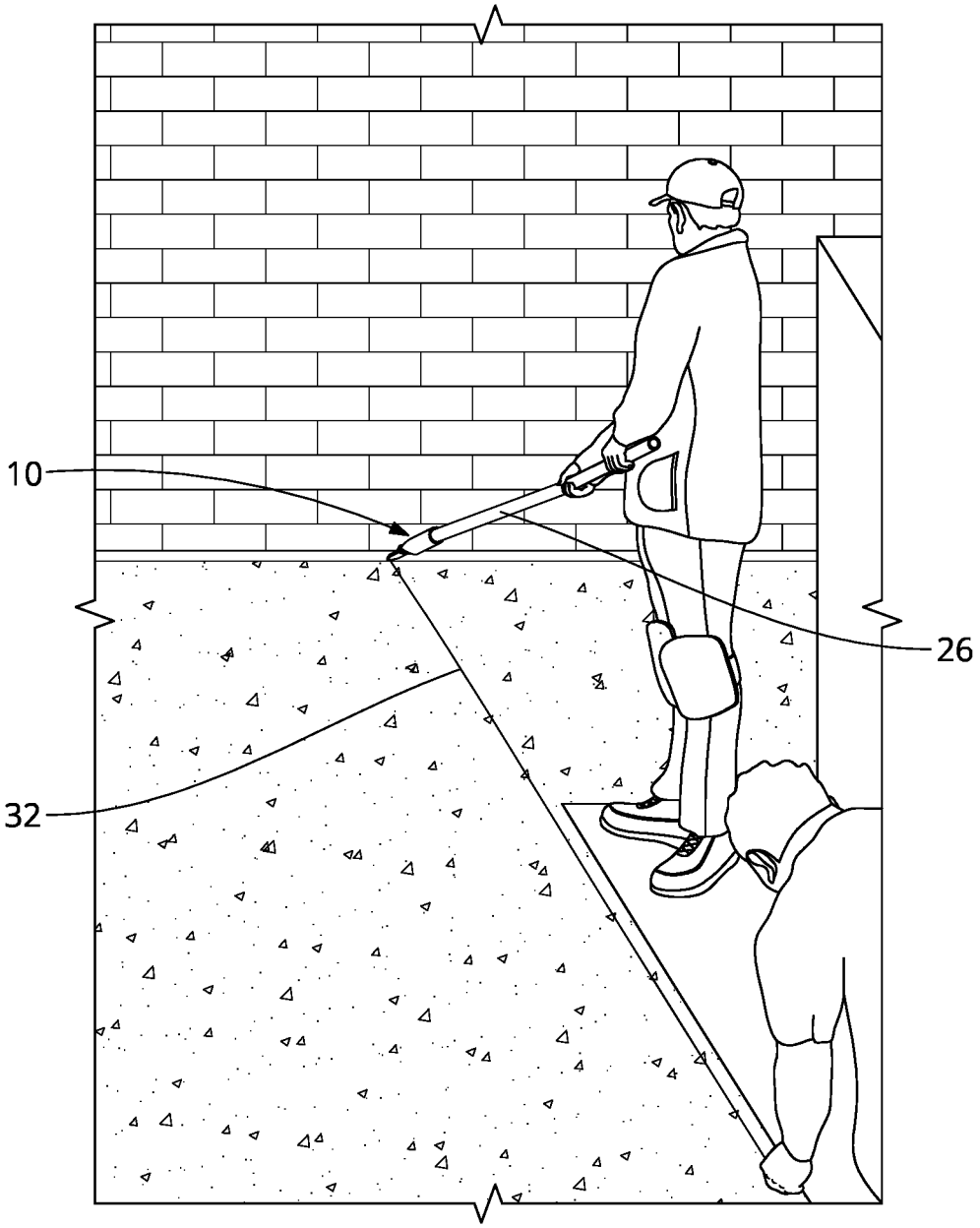
FIG. 8 depicts the tool in use for marking a line in wet cement, according to certain embodiments.

According to certain embodiments, disclosed is a system for manipulating a string line which provides a line engagement tool 10 configured to attach a string line 32 to a pole 26. In embodiments, the disclosed system allows string line 32 to be set at a location beyond a user's arm length. The disclosed system further provides an improved method for marking a line in wet concrete, cement, or similar material, as will be described.

In certain embodiments as depicted in the figures, tool 10 may comprise an elongated body including a lower body section 12 configured to couple to the end of pole 26, and an upper body section 18 configured to engage string line 32. According to an exemplary embodiment, lower body section 12 and upper body section 18 may form a continuous piece with a tapering transition section 15 therebetween as shown in the figures, but not necessarily so. In certain embodiments, pole 26 may be a standard extension pole 26, which may typically be used to attach to various tool attachments as is known in the industry. Such pole may include a spring-loaded button 28 as is known. It shall be appreciated however, that the disclosed tool may be configured for use with different types of poles in alternate embodiments.

In some embodiments, tool 10 may comprise an internal slot 14 forming a cylindrical hollow 14A within lower body section 12. In one embodiment internal slot 14 may extend upwards into transition section 15, wherein it may taper as shown in the figures, but not necessarily so. In certain embodiments, cylindrical hollow 14A is configured to receive the end of pole 26. According to an exemplary embodiment, cylindrical hollow 14A may have an internal diameter of about 1 5/16 inch, and a length "L" of about 5 inches for snuggly receiving a corresponding length of the end of pole 26 having a diameter of about 1 1/4 inch. In some further embodiments, tool 10 may include a button hole 16 within lower body section 12, which is continuous with cylindrical hollow 14A and configured to receive spring-loaded button 28. As such, in attaching the tool to pole 26, the end of the pole is inserted into cylindrical hollow 14A, wherein spring-loaded button 28 may retract under pressure imposed by the side wall of cylindrical hollow 14A as pole 26 is slid into cylindrical hollow 14A. Button hole 16 is sized and positioned to allow spring-loaded button 28 to pass through it. Therefore, once the button hole 16 and spring-loaded button 28 are brought together, the button springs outwards from the hole to create a non-permanent locking mechanism that attaches tool 10 to pole 26. According to an exemplary embodiment, button hole 16 may be positioned approximately 2 inches from the bottom end 12A of tool 10 and has a diameter of about 3/8 inches for receiving a button with a diameter of about 5/16 inches.

It shall be appreciated that the dimensions of cylindrical hollow 14A and position and dimensions of button hole 16 may vary in alternate embodiments deepening on the size dimensions of the pole and dimensions and position of the spring-loaded button on the pole. Additionally, it shall be appreciated that while lower body section 12 is depicted as a cylindrical tube, it is not necessarily limited to this configuration. Furthermore, tool 10 may be configured to attach to a pole without a spring loaded button in alternate embodiments, and as such may omit button hole 16. In some further alternate embodiments, the surrounding wall defining cylindrical hollow 14A may comprise a high-friction and/or compressive material for securing to the end of pole 26, which may be particularly beneficial for a pole that does not include a spring loaded button.

In certain embodiments, upper body section 18 may comprise one or more string line engagement element(s) for capturing string line 32. In some embodiments, the string line engagement element(s) may comprise a string line wedge slot 24 configured to capture a section of the string line and/or a string line loop hook 22 configured to engage a loop 30 formed within string line 32. In one embodiment, string line wedge slot 24 and string line loop hook 22 may be formed within a main support member 18A of upper body section 18. In certain embodiments, main support member 18A may comprise a plate including opposing planar faces and side walls 18B between the planar faces. Main support member 18A (also referred to as "support plate 18A" or "planar support member 18A") extends upwards from transition section 15.

In certain embodiments, support plate 18A may include a top section which tapers upwards to form a narrow tip 18C at the top end of support plate 18A. In some embodiments, string line wedge slot 24 may comprise a narrow V-shaped opening or slot formed within tip 18C as shown, and is configured to allow string line 32 wedge inside. In some embodiments, string line loop hook 22 may extend from one of the opposing planar faces of support plate 18A (referred to herein as "first planar face" for convention), wherein loop hook 22 is positioned below wedge slot 24. In one embodiment, loop hook 22 may have a planar body which may extend perpendicularly from the planar face of support plate 18A. In further embodiments, the loop hook planar body may have an angled geometry which tapers upwards towards tip 18A. In further embodiments, a loop capture slot 22A may be provided at the lower end of loop hook 22.

In certain embodiments, support fins 20 may be provided between transition section 15 and main support member 18A and are configured to provide structural support to support plate 18A. In one embodiment as depicted in the figures, transition section 15 comprises a pair of opposing angled planar platforms 15A, which are angled upwards from lower body section 12 and converge to form a top support platform 15B therebetween. Support plate 18A is supported on and vertically extends upwards from top support platform 15B. A first pair of fins 20 extends transversely between the first planar face of support plate 18A and a first planar platform of the pair of planar platforms 15A, the first planar face and the first planar platform being adjacent to one another. Likewise, a first pair of fins 20 extends transversely between a second planar face of support plate 18A and a second planar platform of the pair of planar platforms 15A, the second planar face and the second planar platform being adjacent one another and opposite the first planar face and the first planar platform. In some embodiments, fins 20 may taper upwards as shown in the figures. In some embodiments, the upwards tapering is achieved via a rounded profile of fins 20. In one embodiment, loop hook 22 may be positioned symmetrically between fins 20 supporting the first planar face, as depicted.

Thus, string line 32 may be looped around loop hook 22 and engaged within loop capture slot 22A. Additionally, an adjacent non-looped section of string line 32 may be held within wedge slot 24 to securely hold the line within upper body section 18 of tool 10. As such, string line 32 may be engaged within upper section 18, and the tool may be attached onto pole 26. This allows the engaged end of the string line to reach into a location which may be beyond the user's reach and/or not practically accessible to the user and held in place using the tool and pole. Thereafter, a second user may stretch the line out to create straight line mark in wet cement or concrete, whereby the string and tool are removed once the line has been marked. In embodiments, the upwards tapered/angled geometry of tool 10 and its various components provides a pointed and aerodynamic body to facilitate engagement within the wet cement and for easier handling. It shall be appreciated however, that various geometric configurations may suffice in alternate embodiments.

In certain embodiments, tool 10 may be a single unitary piece, but is not limited to this option. In one embodiment, tool 10 may be made of a plastic material via injection molding but is not limited to this option. It shall be appreciated that the disclosed tool and system can have multiple configurations in different embodiments. For example, the disclosed tool may be used for other applications that require remote manipulation of a string line and/or for marking a chalk line. It shall be appreciated that the device and system described herein may comprise any alternative known materials in the field and be of any size and/or dimensions. It shall be appreciated that the device may be manufactured and assembled using any known techniques in the field.

It shall be understood that the orientation or positional relationship indicated by terms such as "upper", "lower", "front", "rear", "left", "right", "top", "bottom", "inside", "outside" is based on the orientation or positional relationship shown in the accompanying drawings, which is only for convenience and simplification of describing the disclosed subject matter, rather than indicating or implying that the indicated device or element must have a specific orientation or are constructed and operated in a specific orientation, and therefore should not be construed as a limitation of the present invention.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A string line engagement tool, comprising:

a lower body section including a cylindrical hollow configured to receive an end of a pole inserted into the cylindrical hollow for attachment of the string line engagement tool to the pole; and an upper body section coupled to the lower body section, and configured to engage a string line, the upper body section comprising at least one of a string line wedge slot configured to capture a segment of the string line, and/or a string line loop hook configured to engage a loop formed within the string line.

2. The string line engagement tool of claim 1, further comprising a hole within the lower body section, the hole being continuous with the cylindrical hollow and configured to receive a spring loaded button of the pole inserted into the cylindrical hollow.

3. The string line engagement tool of claim 1, said upper body section comprising a support member including a top end tip, wherein the string line wedge slot is formed within the top end tip.

4. The string line engagement tool of claim 3, wherein the string line loop hook is provided on the support member between the top end tip and the lower body section.

5. The string line engagement tool of claim 4, said support member including a first planer face and a second planar face opposite the first planer face, and a side wall between the first planar face and the second planar face, wherein the string line wedge slot is formed within a top end of the side wall defining said top end tip, and wherein the string line loop hook is supported on the first planar face below the top end tip.

6. The string line engagement tool of claim 5, wherein first body section and second body section form a continuous piece with a tapering transition section therebetween, the string line engagement tool further comprising at least one support fin disposed between the tapering transition section and at least one of the first planar face and the second planar face.

7. A string line marking method, comprising:

attaching a portion of a string line to a pole using a string line engagement tool, the string line engagement tool comprising:

a lower body section including a cylindrical hollow configured to receive an end of the pole inserted into the cylindrical hollow for attachment of the string line engagement tool to the pole; and an upper body section coupled to the lower body section, and configured to engage a string line, the upper body section comprising at least one of a string line wedge slot configured to capture a segment of the string line, and/or a string line loop hook configured to engage a loop formed within the string line, wherein attaching said portion of the string line to the pole comprises inserting the end of the pole into the cylindrical hollow of the lower body section, and attaching the string line to the string line wedge slot and/or loop hook of the upper body section; and positioning the attached portion of the string line within wet concrete or cement and holding it in place using the pole, whereby the string line may be stretched out from the attached portion to mark a straight line within the wet concrete or cement.

8. The string marking method of claim 7, the string line engagement tool further comprising a hole within the lower body section, the hole being continuous with the cylindrical hollow and configured to receive a spring loaded button of the pole inserted into the cylindrical hollow, wherein inserting the end of the pole into the cylindrical hollow comprises depressing the spring loaded button of the pole to slide the pole into the cylindrical hollow, and bringing the spring loaded button to the hole to allow the spring loaded button to pass through the hole, such that the spring-loaded button springs outwards from the hole.

9. The string marking method of claim 7, said upper body section of the string line engagement tool comprising a support member including a top end tip, wherein the string line wedge slot is formed within the top end tip, wherein attaching the string line comprises using the string line wedge slot to capture the string line.

10. The string marking method of claim 9, wherein the string line loop hook is provided on the support member between the top end tip and the lower body section, wherein attaching the string line further comprises engaging a loop within the string line to the string line loop hook.

* * * * *